US006786847B1

(12) United States Patent
Morgan et al.

(10) Patent No.: US 6,786,847 B1
(45) Date of Patent: Sep. 7, 2004

(54) AUTOMATED COMPLETE EXERCISE SYSTEM

(76) Inventors: Curt Morgan, 15150 Amaral Rd., Castroville, CA (US) 95012; James Dawson, 265 Myrtle St., Laguna Beach, CA (US) 92651

( * ) Notice: Subject to any disclaimer, the term of this patent is extended or adjusted under 35 U.S.C. 154(b) by 144 days.

(21) Appl. No.: 10/262,357

(22) Filed: Sep. 30, 2002

(51) Int. Cl.[7] ..... A53B 21/02
(52) U.S. Cl. ..... 482/6; 482/96; 482/142
(58) Field of Search ..... 482/1–9, 92, 95, 482/96, 130, 142; 601/23–35

(56) References Cited

U.S. PATENT DOCUMENTS 5,263,913 A * 11/1993 Boren ..... 482/96
5,938,571 A * 8/1999 Stevens ..... 482/96
5,967,955 A * 10/1999 Westfall et al. ..... 482/142

* cited by examiner

*Primary Examiner*—Glenn E. Richmon
(74) *Attorney, Agent, or Firm*—John Schipper

(57) ABSTRACT

Exercise/therapy apparatus that allows a user to change one or more workout parameters without dismounting from the apparatus and without interrupting the workout. Several embodiments for inclined surface apparatus are disclosed, using vertical, tiltable and curvilinear surface support structures.

45 Claims, 6 Drawing Sheets

AUTOMATED COMPLETE EXERCISE SYSTEM

FIELD OF THE INVENTION

This invention relates to physical exercise equipment.

BACKGROUND OF THE INVENTION

Physical exercise and/or therapy are pursued by an estimated 15 million persons in the United States. Many of these work-out regimens require a change, from time to time, in the physical resistance against which the user works. In most instances, this requires that the user stop exercising and/or dismount from the exercise/therapy apparatus in order to manually adjust a mechanical setting to change one or more physical resistance parameters.

What is needed is an exercise/therapy system where (1) the user can adjust the physical resistance or other parameters while the exercise is in progress, without dismounting or interrupting the workout, and/or (2) the system can be programmed to automatically adjust the physical resistance or other parameters, in response to (i) completion of user cycles of work, (ii) a sensing of the user's present level of efficiency or (iii) lapse of time since the user began the present workout session. Preferably, the system should provide a display of the user's present performance, optionally comparing present performance with a weighted performance index for one or more comparable preceding exercise sessions for the user. Preferably, the system should allow a session-by-session choice of the parameters that can be varied by the user.

SUMMARY OF THE INVENTION

These needs are met by the invention, which provides a system for adjusting the physical resistance and/or one or more other relevant parameters for an exercise/therapy machine, without requiring the user to stop exercising and/or to dismount. Where the exercise/therapy machine ("E/T" machine) in a first embodiment involves a user supported by and moving along an inclined plane, the system includes: an inclined plane body support, supported on a floor or similar foundation at a first end by at least one horizontal translation wheel that rolls on the floor and thereby allows the first end to be translated; a substantially vertically oriented support that receives and holds and allows rotation of a second end of the body support so that the body support is held at a selected angle relative to the floor; and a vertical translation mechanism, associated with the vertical support, that translates the second end of the body support vertically by a selected amount in response to receipt of an electronic or mechanical command from a command processor controlled by the user or pre-programmed, without requiring that the user (1) dismount from the body support and /or (2) stop and restart the present exercise motion. The command processor can be incorporated within an E/T mechanism that provides the force(s) against which the user works.

In another embodiment, the vertical support is replaced by a tiltable support whose tilt angle varies with the incline angle between the inclined plane and a plane of the floor or foundation. In another embodiment, the vertical support is replaced by a curvilinear support that has the shape of a sector of a circle, with circle center coinciding with the lower end of the inclined plane.

DESCRIPTION OF BEST MODES OF THE INVENTION

The E/T system, according to the invention, is a general purpose conditioning and testing device in which resistance to work performed, the workout routine to be followed, the total work (or number of repetitions) to be performed and/or one or more other relevant E/T parameters is variable and programmable. When a user is exercising and engaging in therapy, the system or the user can alter, for example, the amount of work performed by the user in a given cycle, without requiring the user to dismount or to substantially interrupt the workout routine. This alteration of an E/T parameter can be implemented at any time, such as during a single exercise repetition or cycle, or between cycles, using an electro-mechanical control system. Alteration may be performed automatically by the control system, in a pre-programmed manner, in response to occurrence of a single event or of a group of events (number of cycles completed, etc.), or manually by entry of a user command, without user dismount or interruption of a workout.

In one group of embodiments, the E/T machine includes an inclined plane body support for the user, and physical resistance is provided by gravitational and frictional forces acting on a movable bed that rolls or otherwise moves along the inclined plane. The user can assume various exercise positions (seated, supine, prone, kneeling, side-lying, etc.) on the moving bed and can use handles, cables, pulleys, foot plates and similar devices to pull and/or push the user up and down the inclined plane. The resistance to motion up and down the plane involves the angle of incline, the user's weight, the friction experienced by the rollers at the incline angle, cable pulley ratios and possibly other factors. In order to vary the E/T resistance, the incline angle is changed, by raising or lowering one end of the inclined plane relative to the other end. The control system controls the incline angle and optionally monitors, calculates, displays, stores and prints records of various exercise parameters, such as user stroke length, number of cycles, amount of work performed for each cycle, time consumed for each cycle or for a group of cycles, etc. The control system can incorporate, or be associated with, a computer to further enhance data accumulation, computation and display.

A personal memory card, setting forth the personal training program(s), physical resistance parameters and other data preferred for use by the card holder, can be carried by the user. This card, when inserted into and read by the E/T system, instantly personalizes the workout program(s) presented for the user. This card can also communicate with an associated computer to allow analysis, storage and printout of workout data, as well as entering of workout program changes and additions.

Figure 1:
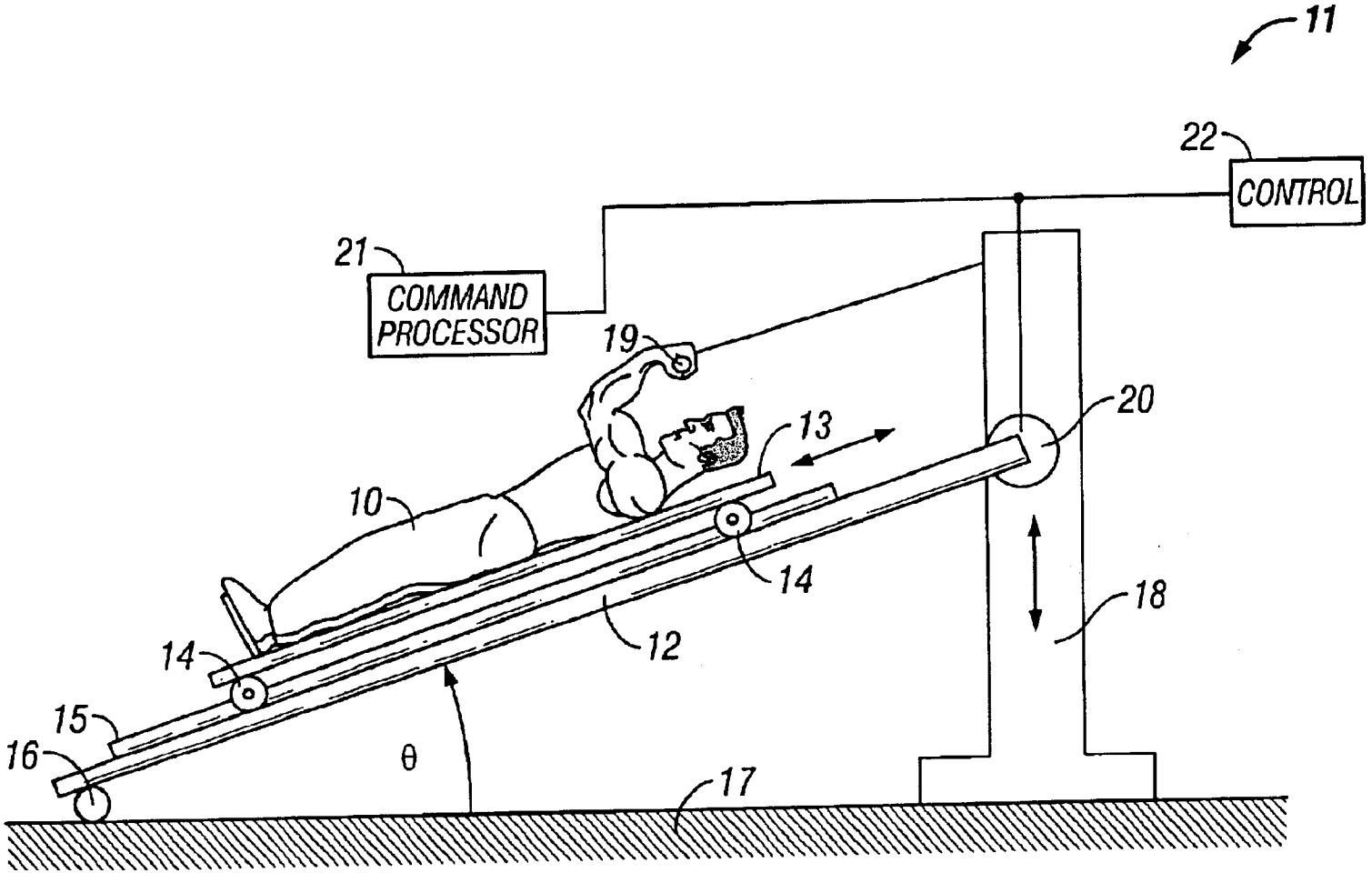
FIGS. 1, 5, 7 and 8 schematically illustrate an inclined plane body support system configured to practice three embodiments of the invention.

In a first embodiment, illustrated in FIG. 1, the E/T system 11 includes: an inclined surface (e.g., an inclined plane) 12; a movable bed and body support 13; a bed movement mechanism (e.g., rollers, wheels, bearings or a friction block, collectively referred to as "rollers") 14; one or more bed guidance mechanisms (e.g., one or more rails) 15 (optional) to keep the movable bed on the inclined surface 12; one or more rollers or wheels 16 attached to a first end of the inclined surface 12, which rests upon and moves along a floor or foundation 17 for the system 11; a vertically oriented support 18 that receives, holds and allows rotation and/or elevation of the second end of the inclined surface 12 relative to the vertical axis of the vertical support; a user movement mechanism 19, including but not limited to hand pulls, feet pulls, feet pushers, etc., that are used by the user 10 to move the movable bed 13 along the inclined surface 12; a motor or other vertical translation mechanism 20, associated with the vertical support, that vertically translates the second end of the inclined surface 12 relative to the floor 17, upon receipt of an electronic or mechanical command from a command processor 21 or from an associated control module 22. As the second end of the inclined surface 12 moves vertically relative to the first end, the incline angle θ between the plane of the floor 17 and the plane of the inclined surface changes. Use of a higher angle θ normally requires that the user do more work in completing an E/T cycle.

Vertical Support. The vertical support mechanism 18 in FIG. 1 provides structural support for the second (upper) end of the inclined surface 12 and includes a coupling that either slides vertically up and down the outside, or the nside, of the mechanism. Optionally, this coupling is attached to the inclined surface 12 or to the bed guidance mechanism 15 so that the bed 13 can be moved up or down the slant height of the inclined surface. Optionally, a pulley cross bar is attached to the coupling to provide one or more pulley mount locations that are approximately aligned with the bed guide. For safety reasons all gearing and movable drive components are preferably enclosed in a housing.

Motorized Drive. A motorized drive system is included to drive the vertical column coupling up and down the support mechanism in FIGS. 1, 5 and 7, and thus alter the incline angle. The motor may be a reversible ac motor, a reversible dc motor or a stepper motor, coupled in some manner to the support column coupling. Various methods may be used to allow the motor to drive the support coupling along the support column. In a first method, a lead screw and nut assembly is positioned so that the lead screw is vertical bearing and is rotated by the motor. The nut is attached to the moving coupling so that, when the lead screw is turned, the nut and coupling assembly moves up and down the lead screw. A second method uses an endless loop chain drive that moves between top and bottom sprockets located at two ends of the support column. A motor with an internal gear box drives the bottom sprocket and thus causes the chain to move. The chain is attached to the movable coupling, which moves when the chain is driven by rotation of the bottom sprocket. A third method uses a motorized winch, located at the bottom of the support column. A cable is wound or unwound to move the coupling up or down, respectively. The cable is preferably looped over an upper pulley and is connected to the coupling. As the cable is reeled in (out), the coupling moves up (down).

User Exercise Movement. Optionally, the user movement mechanism 19 (for example, a hand held bar, as shown in FIG. 1) may include part or all of the command processor 21 so that the user 10 may activate a parameter change without removing the user's hand (or foot) from the mechanism 19.

Personal Memory Card. A personal memory card PMC, setting forth the personal training program(s), physical resistance parameters and other data preferred for use by the card holder, can be carried by the user. This card, when inserted into and read by the command processor 21 and/or the control module 22, instantly personalizes the workout program(s) presented for the user 10. This card can also communicate with a microprocessor or other computer in the control module 22 to allow analysis, storage and printout of workout data, as well as facilitating entry of workout program changes and additions.

Command Processor and Control Module. The command processor 21 may be user controlled, by manual entry of a command for a parameter change by the user or another person, or may be automatically controlled by a programmable microprocessor or other automated control module 22 that issues commands for one or more parameter changes in response to one or more of: lapse of a selected interval of time; completion of a selected number of exercise or therapy cycles, sensed accumulated expenditure by the user of a selected amount of work (optionally involving more than one cycle), sensed user efficiency for a given cycle (e.g., work expended versus minimum work required for that user to complete a cycle), or a weighted combination of these measures.

Figure 2:
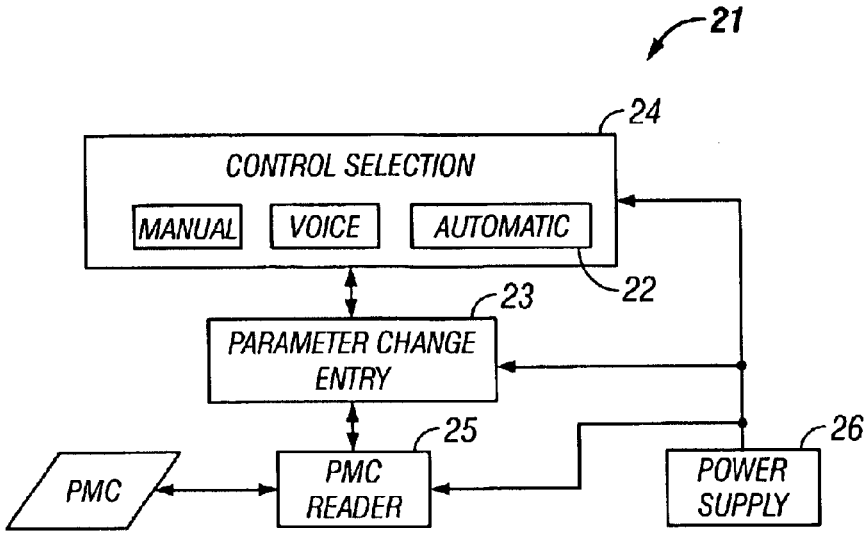
FIGS. 2 and 3 schematically illustrate an embodiment of a command processor and a control system that are part of the invention.

A suitable command processor 21, illustrated in more detail in FIG. 2, will include: a parameter change manual entry mechanism 23, such as a user-controlled small keyboard or toggle switch (up/down); a control selection switch 24 that determines whether manual, voice or automatic parameter change commands will be received and implemented; a PMC reader 25 (optional) that accepts and reads the user's PMC and provides the user with a personalized workout and/or with an illustrated guide for a recommended workout; and a power supply 26. The parameter change entry mechanism 23 optionally allows a choice of one or more parameters that are to be changed, a choice of the numerical value of the parameter(s) to be changed, and/or a choice of the workout to be followed (including override of the workout recommended by the PMC).

Figure 3:
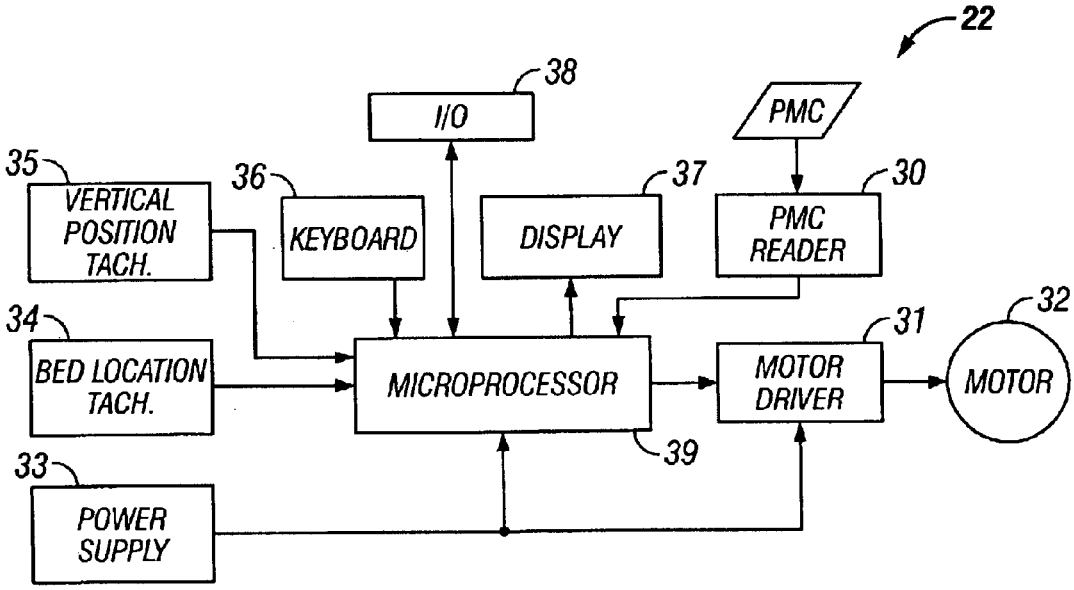

The control system 22, illustrated in more detail in FIG. 3, for the E/T system includes: a PMC reader 30 (optional) that accepts a PMC and instantly personalizes the workout program(s) presented for the user 10; a motor driver module 31 to control a motor 32 that changes one or more workout parameters; a power supply module 33, a bed location module 34, a support column position module 35, a data/command entry module 36 (e.g., a keyboard; optional), a visual display module 37 (optional), an I/O port 38, and a microprocessor 39 that controls the other modules. The motor driver control module 31 transmits signals to cause the motor 32 to start and stop (and, optionally, to reverse direction of the motor and/or to control motor speed). The bed location module 34 monitors the location of the bed 13 to determine stroke length L and number of cycles completed by the user, for optional display. The support column position module 35 monitors a vertical or other position of the support column coupler and allows the microprocessor 39 to monitor and control the motor 31, the motor driver module 31 and the support column position module 35 in a closed loop. The data/command entry module 36 allows the user (or another person) to enter commands to change one or more E/T parameters, to change the format and content of what is displayed on the visual display module 28, to recall or analyze other data accumulated by the system during the user's workout, and to activate and/or deactivate the system. Selected programs can be stored or modified, using the microprocessor 39. Exercise/therapy protocol and sequencing can be commanded or changed manually (using push buttons or the keyboard), by voice control, by programming of automatic sequences or by similar input means.

An alphanumerical and bar graph display unit accumulates, stores, calculates and/or displays the values of E/T variables, such as exercise resistance parameter value, average or present stroke length, number of cycles completed, average or present time per cycle, bed location on the inclined plane, incline angle, accumulated work, an indicium or description representing the workout followed by the user, and similar variables.

One or more components for the control module 22 may be incorporated into the command processor 21. If the user is likely to enter one or more parameter change commands manually, by keyboard entry or by voice-based entry, part or all of the command processor 21 should be located adjacent to the user 10 in FIG. 1 so that the user can enter the changes without dismounting and without interrupting the user's workout. Where the parameter change commands are only to be entered automatically, the command processor 21 and/or the control module 22 can be located at any convenient place relative to the movable bed 13.

Figure 4A:
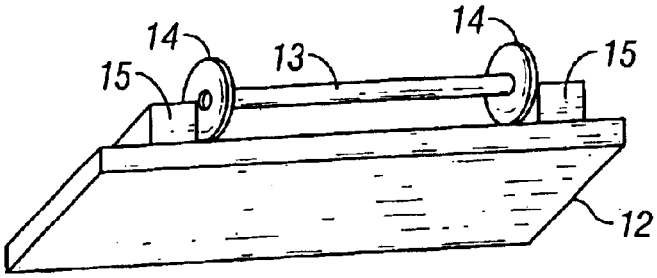
FIGS. 4A, 4B, 4C and 4D are end views of inclined surfaces that rely on different approaches to controlling lateral movement of a movable bed.

Preferably, the movable bed 13 moves along the inclined surface 12 under the influence of a bed guide mechanism 15 that prevents the bed from leaving the inclined surface in a lateral direction. The movable bed 13 optionally includes a cushioned bed or body receptacle having one, two, three, four or more rollers 14 that move(s) along the bed guide mechanism 15. In a first version, the inclined surface 12 is an inclined plane, and the bed guide mechanism 15 is one, two or more rails on which the bed roller(s) ride(s), on the inside or between the rail(s), as illustrated in an end view of the inclined surface 12 in FIG. 4A. Where two or more rails are used in this version, adjacent rails preferably have spacer bars to maintain a selected distance between two adjacent rails. Rollers 14 are constrained to move on the rail(s) or between two adjacent rails. Optionally, each rail is broken at one or more intermediate points to allow the inclined plane and/or rail(s) to be folded or telescoped, to conserve space and/or to provide portability of the E/T apparatus. In a second version of the bed guidance mechanism, illustrated in FIG. 4B, two or more rollers 14 move on the outside of the rails 15.

Figure 4C:
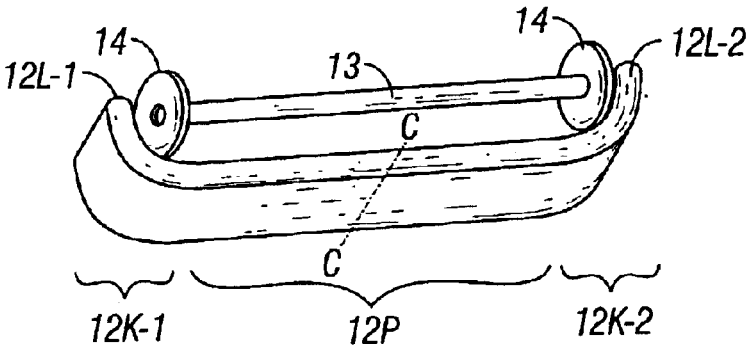

In a third version of the bed guide mechanism 15, the inclined surface 12 is a central planar region 12P that is provided with a "curl" region, 12K-1 and 12K-2 on each of two lateral edges, 12L-1 and 12L-2, of the inclined surface, as illustrated in FIG. 4C. A curl is a portion adjacent to an edge of the inclined surface 12, that has a curvilinear cross section that curls upward and inward toward a central axis CC of the inclined surface. Provision of a curl on each of two lateral edges, 12L-2 and 12L-2, of the inclined surface 12 forces the bed 13 and associated roller(s) 14 to remain on the inclined surface, between the two curl regions, 12K-1 and 12K-2, and thereby controls the bed and prevents the bed from leaving the inclined surface in a lateral direction. Optionally, a curl region can be provided at each of two, three, four or more edges of the inclined surface 12.

Figure 4D:
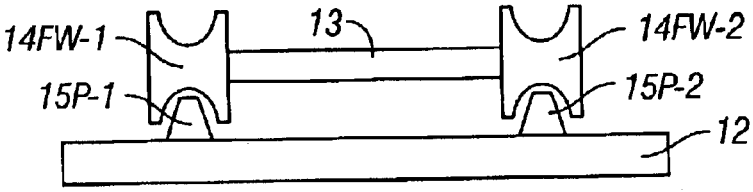
Figure 4B:
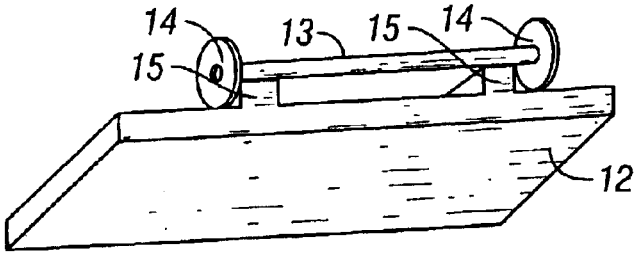

In a third version of the bed guide mechanism 15, illustrated in FIG. 4D, the inclined surface 12 is provided with one or more spaced apart projections or rails, 15P-1 and 15P-2 (preferably at least two such projections), and each roller(s) is a fraction of a wheel, 14FW-1 and 14FW-2, that is opened so that a concave inner part of each wheel rides on a corresponding projection, 15P-1 or 15P-2. Lateral movement of each wheel, 14FW-1 and 14FW-2, and thus of the bed 12 that rides upon the wheel(s), is sharply limited by contact of the concave inner part of each wheel with the corresponding projection, 15P-1 and 15P-2.

Figure 5:
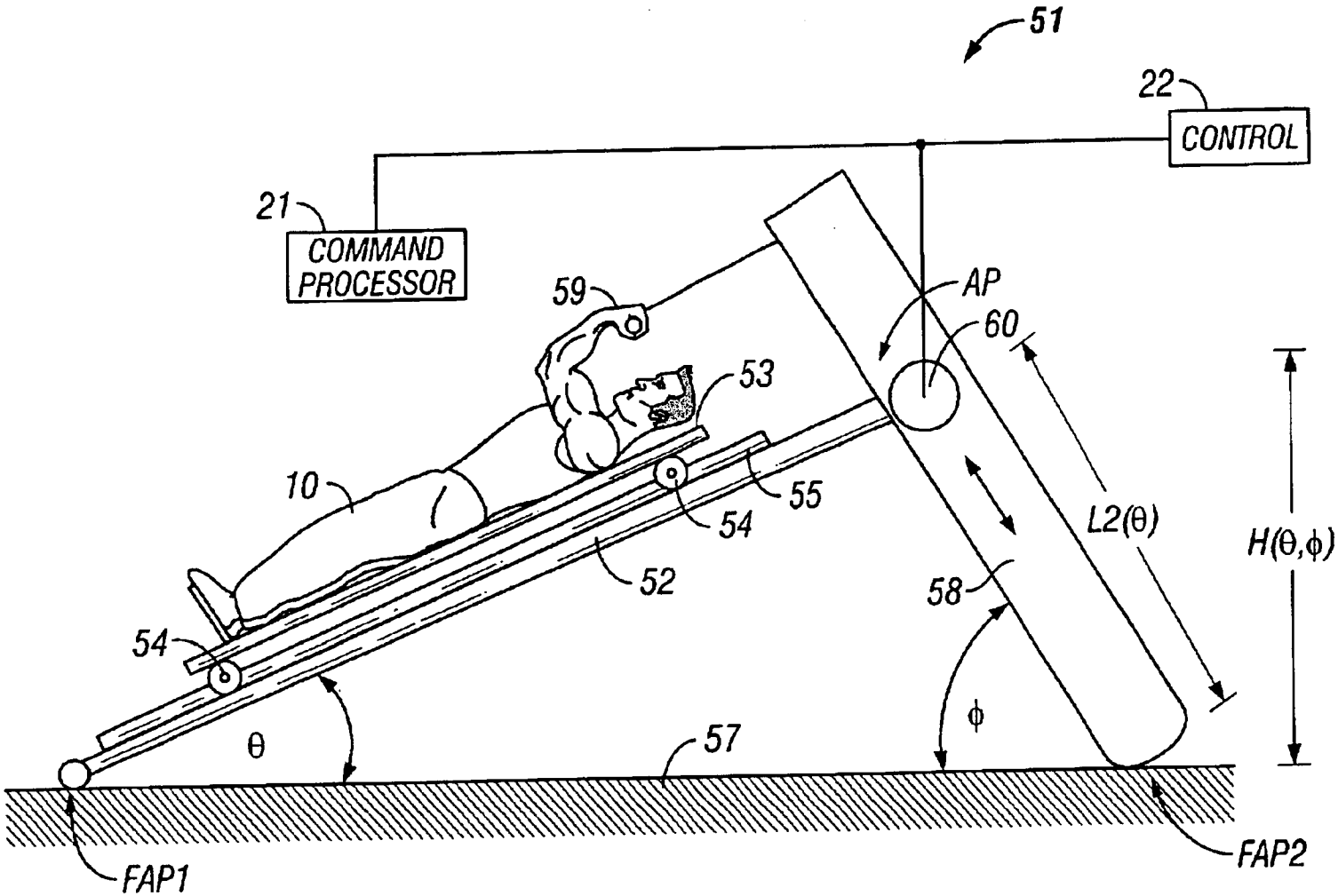

FIG. 5 illustrates another embodiment of the invention. The system 51 in FIG. 5 includes an inclined surface 52; a movable bed and body support 53; a bed movement mechanism (e.g., rollers or wheels) 54; a bed guidance mechanism 55 to keep the movable bed on the inclined surface; a first end of the inclined surface rests upon, but does not substantially move along, a floor or foundation 57 for the system 51; a tiltable support 58 that receives, holds and allows rotation of a second end of the inclined surface; a user movement mechanism 59, including but not limited to hand pulls, feet pulls, feet pushers, etc., that are used by the user 10 to move the movable bed 53 along the inclined surface 52; a motor or other linear translation mechanism 60, associated with the tiltable support 58, that vertically translates the second end of the inclined surface relative to the floor 57, upon receipt of an electronic or mechanical command from a command processor 21. As the second end of the inclined surface 52 moves vertically relative to the first end, the incline angle θ between the plane of the floor 57 and a plane of the inclined surface changes. Use of a higher angle θ normally requires that the user do more work in completing an E/T cycle.

As the angle θ is changed and the height H of the second end of the inclined surface 52 changes relative to the floor 57, either automatically or in response to entry of a parameter change command by the user 10, a tilt angle ϕ of the tiltable support 48 optionally changes in response to, or to facilitate, change of the height H. A distance L between the first end of the inclined surface 52 and a lower end of the tiltable support 58 may be fixed or may vary with variation of one or both of the angles θ and ϕ. The first end of the inclined surface 52 may translate horizontally as the angles θ and ϕ change.

Figure 6:
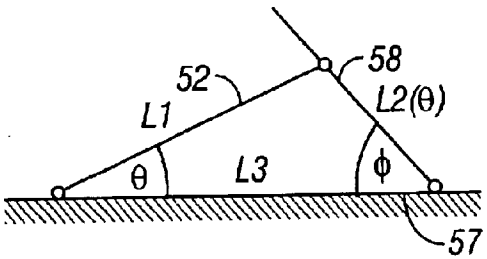
FIG. 6 illustrates a length relationship used in the embodiment in FIG. 5.

As one example of this relationship, the second end of the inclined surface 52 may be rotatably attached to the tiltable support at a selected attachment point AP so that the inclined surface rotates around the attachment point AP. The length L1 of the inclined surface 52 is constant, but the distance H(θ,ϕ) of the attachment point AP from the floor attachment point FAP2 varies with the angles θ and/or ϕ. With reference to FIG. 6, the distance L2(θ) and the tilt angle ϕ is expressed as $$H(\theta,\phi)=\{L1^2+L2^2-2L1\cdot L2.\ \cos\theta\}^{1/2}, \quad (1)$$

$$\tan\phi=\sin\theta/\{(L2/L1)-\cos\theta\}, \quad (2)$$

where L2 is the (fixed) distance between the two attachment points FAP1 and FAP2. The linear translation mechanism 60 is programmed or otherwise arranged to move along the tiltable support by distance increments in order to satisfy Eqs. (1) and (2).

Figure 7:
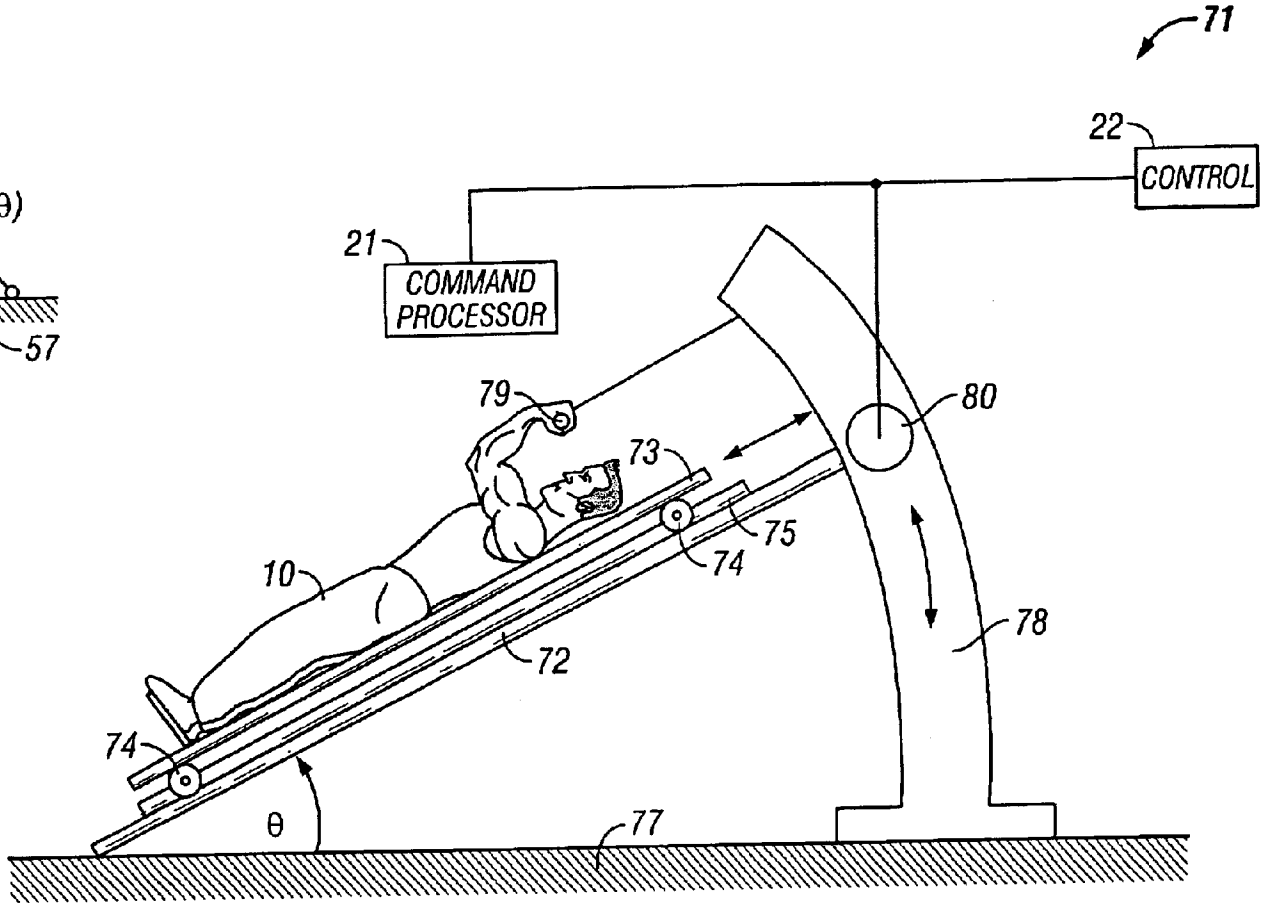

A third embodiment of a system 71, illustrated in FIG. 7, an inclined surface 72; a movable bed and body support 73; a bed movement mechanism (e.g., rollers) 74; a bed guidance mechanism 75 (optional) to keep the movable bed on the inclined plane; a first end of the inclined plane rests upon, but does not substantially move along, a floor or foundation 77 for the system 71; a curvilinear support mechanism 78 that receives, holds and allows rotation of second end of the inclined surface; a user movement mechanism 79, including but not limited to hand pulls, feet pulls, feet pushers, etc., that are used by the user 10 to move the movable bed 73 along the inclined surface 72; a motor or other curvilinear translation mechanism 80, associated with the curvilinear support 78, that translates the second end of the inclined plane along a curve defined by the support 78, upon receipt of an electronic or mechanical command from a command processor 21. As the second end of the inclined surface 72 moves vertically relative to the first end, the incline angle θ between the plane of the floor 77 and the plane of the incline changes. Use of a higher angle θ normally requires that the user do more work in completing an E/T cycle.

In the third embodiment, the curve defining the curvilinear support mechanism 78 is preferably a sector of a circle that having a center at a first attachment point FAP1 for the inclined surface 72. When the inclined surface 72 and the curvilinear support 78 are thus arranged, the curvilinear support 78 need not move, because the distance from the first attachment point FAP1 to the nearest surface of the curvilinear support 78 is constant; the curvilinear translation mechanism 80 moves along the sector of the circle defined by the curvilinear support 78.

The work done by the user in one cycle (e.g., moving the bed 13 from a minimum height to a maximum height along the inclined plane and returning in FIG. 1) can be estimated from the work done to move the total mass m (bed 13 plus rollers 14 plus user 10) from the minimum height to the maximum height (a difference of $h=L\cdot\sin\theta$, where L is the distance the bed moves along the inclined surface and θ is the incline angle) in the presence of roller friction with friction coefficient $\mu$. Assuming that that bed returns to its lowest point without expenditure of additional user work, the work per cycle ΔW is estimated to be $$\Delta W=m\cdot g\cdot L\cdot\sin\theta\{1+\mu\cos\theta\}, \quad (3)$$

where m is total mass, g is the local gravity factor, and the bed moves a (stroke) distance L along the inclined surface during the "upward" portion of the cycle. Equation (3) can be used to estimate the work done by the user per cycle, where the incline angle is θ. The user may change one or more workout parameters, such as a physical resistance parameter (e.g., θ and/or L) or a workout sequence, without dismounting or interrupting the workout itself, using the command processor.

Figure 8:
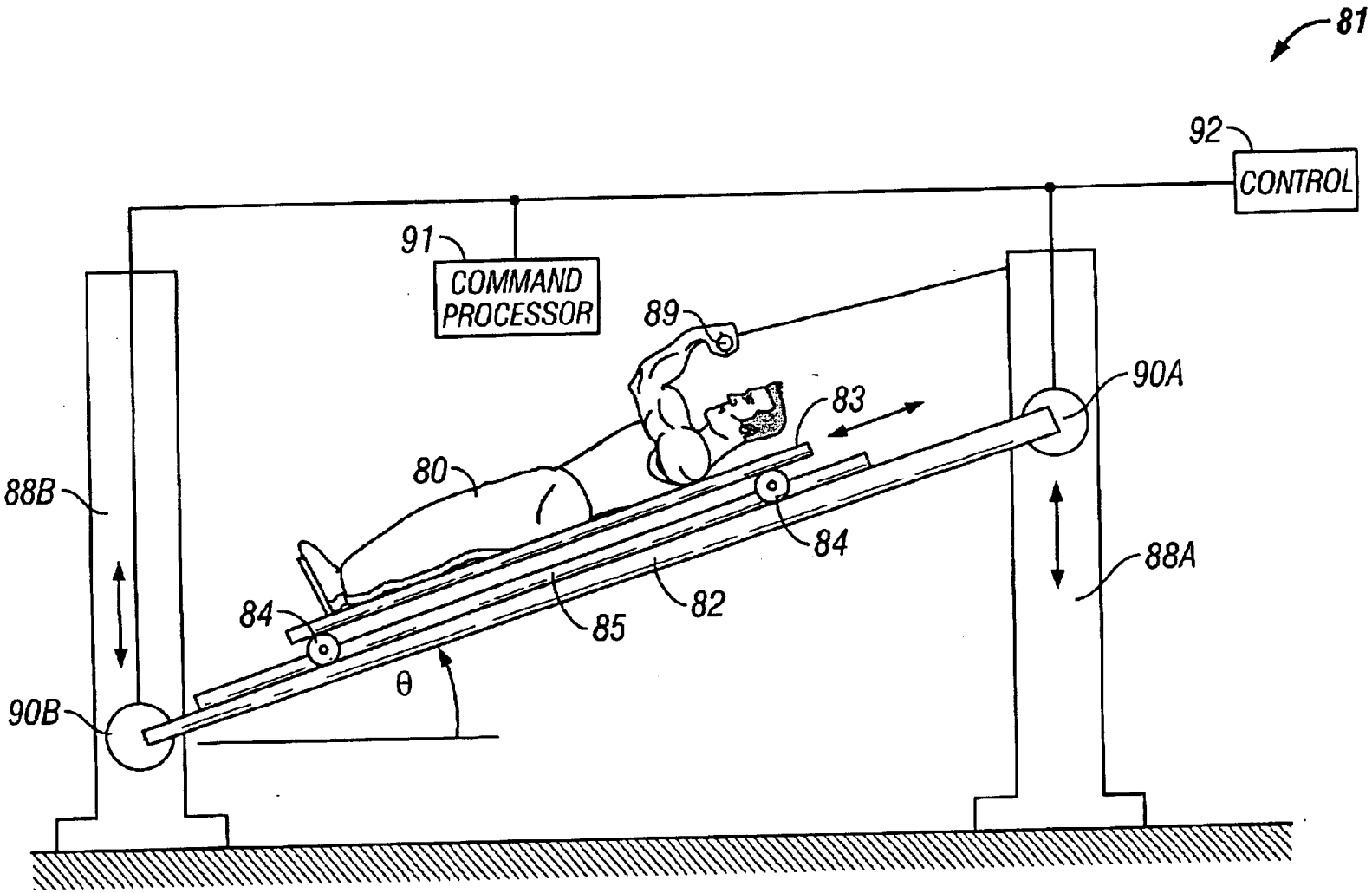

Optionally, a vertical support mechanism, 88A and 88B, can be provided at each of the first end and the second end of the inclined surface 82 in a fourth embodiment 81, as illustrated in FIG. 8, and an independently operable vertical translation mechanism, 90A and 90B, can be provided for each of these two vertical support mechanisms. In this version, the first end and the second end of the inclined surface 82 are moved up and down independently, and the height difference of the first end and the second end in part determines the incline angle. A movable bed 83 moves along the inclined surface on rollers 84 that are constrained by a bed guidance mechanism 85. A user 80 undergoes exercise or therapy motion using a user movement mechanism 89 and controls and changes one or more parameters using a command processor 91 and a corresponding control module 92.

Preferably, the E/T system is portable and can be disassembled into two or more components that are more easily stored, transported, or rearranged into another E/T configuration. The movable bed is removable from the inclined surface. The inclined surface and the bed guidance mechanism are optionally disassembled into two or more pieces and can be detached from the support mechanism and from the vertical translation mechanism. Arrangements for disassembly of the system 11 are well known.

Figure 9:
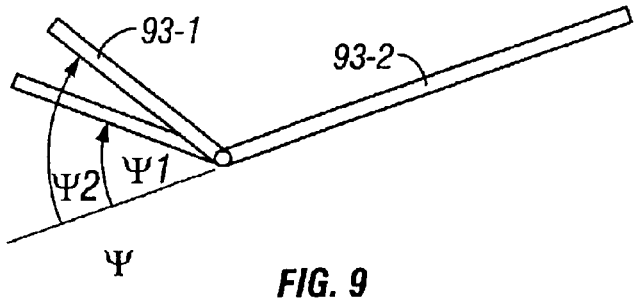
FIG. 9 illustrates adjustment of user seat tilt angle.

Optionally, a portion 93-1 of the movable bed tilts up and latches relative to the remainder 93-2 of the bed, as illustrated in FIG. 9, to form a seat with user back support for certain exercises, such as rowing. Preferably, the seat tilt angle Ψ can be adjusted by the user to any of two or more discrete or continuously variable tilt angle values.

Optionally, the display module 37 in the control module 22 in FIG. 3 permits visual illustration of a selected workout and display of workout performance and/or workout parameters that can be adjusted by the user.

Optionally, the movable bed has a compartment that stores E/T components and accessories used for particular workout configurations. This storage unit may accept weights of different sizes that allows change of the total mass m in Eq. (3), as an alternative to change of the incline angle θ.

What is claimed is:

1. Physical exercise/therapy apparatus comprising:

a bed support, comprising an inclined surface, having a bed support first end that is supported on a floor by at least one horizontal translation roller that rolls on the floor and thereby allows the first end to be translated, and having a bed support second end;

a vertically oriented support that receives, holds and allows rotation of the bed support second end so that the bed support is held at a selected incline angle θ relative to the floor;

a user support bed that supports a user and that moves along the bed support between the bed support first end and the second bed support end;

a command processor, located adjacent to or on the support bed, to receive and implement a command for a change in at least one control parameter associated with an exercise/therapy workout by the user;

a vertical translation mechanism, associated with the vertical support, that translates the bed support second end along the vertical support by a selected amount in response to receipt of an electronic signal from the command processor, without requiring that the user dismount from the support bed and without requiring that the user interrupt an exercise/therapy workout.

2. The apparatus of claim 1, wherein said at least one control parameter is drawn from a group consisting of a measure of physical resistance associated with said workout, a parameter specifying the workout routine to be followed, total work to be performed, and number of repetitions to be performed.

3. The apparatus of claim 2, wherein said at least one parameter is drawn from the group of parameters consisting of said incline angle θ, a mass m associated with said user support bed and a distance L that said user support bed moves along said inclined surface in a selected direction.

4. The apparatus of claim 1, wherein said vertically oriented support comprises:

at least one vertically oriented track and at least one vertical translation wheel that is received in and rolls in at least one vertically oriented track; and an activatable motor that, when activated, causes the at least one vertical translation wheel to move vertically in a selected direction by a selected distance in the at least one vertically oriented track.

5. The apparatus of claim 1, wherein said vertically oriented support comprises:

at least one frictional block that moves up and down in at least one vertically oriented track; and an activatable motor that, when activated, causes the at least one frictional block to move vertically in a selected direction by a selected distance in the at least one vertically oriented track.

6. The apparatus of claim 1, wherein said command processor issues at least one of said electronic signals for said change in said at least one control parameter in response to at least one of (i) manual entry by said user of said command and (ii) receipt of a voice command from said user.

7. The apparatus of claim 1, wherein said command processor issues at least one of said electronic signals for said change in said at least one parameter without requiring receipt of a manual entry and without requiring receipt of a voice command from said user.

8. The apparatus of claim 1, wherein said user support bed comprises a storage region that receives and holds two or more weights.

9. The apparatus of claim 1, wherein said user support bed comprises first and second user support components, and the first user support component can be oriented relative to the second user support component at a tilt angle having at least two different tilt angle values.

10. The apparatus of claim 1, further comprising a support bed guidance mechanism that prevents said support bed from moving laterally off said inclined surface.

11. The apparatus of claim 10, wherein said support bed guidance mechanism comprises at least one of: (i) at least one rail, oriented in a selected direction along said inclined surface, which prevents said support bed from moving laterally relative to the selected direction; and (ii) first and second opposing edge regions of said inclined surface that are formed as first and second curvilinear regions that curl upward, where said support bed is received between the first and second curvilinear regions and is guided along said inclined surface in a selected direction that is substantially parallel to at least one of the first and second opposing edges.

12. Physical exercise/therapy apparatus comprising:

a bed support, comprising an inclined surface, having a bed support first end and a bed support second end;

a first vertically oriented support that receives, holds and allows rotation of the bed support first end and a second vertically oriented support that receives, holds and allows rotation of the bed support second end so that the bed support is held at a selected incline angle $\theta$ relative to a selected plane;

a user support bed that supports a user and that moves along the bed support between the bed support first end and the second bed support end;

a command processor, located adjacent to or on the support bed, to receive and implement a command for a change in at least one parameter associated with an exercise/therapy workout by the user;

a first vertical translation mechanism, associated with the vertical support, that translates the bed support first end along the vertical support by a selected amount in response to receipt of an electronic signal from the command processor, without requiring that the user dismount from the support bed and without requiring that the user interrupt an exercise/therapy workout; and a second vertical translation mechanism, associated with the vertical support, that translates the bed support second end along the vertical support by a selected amount in response to receipt of an electronic signal from the command processor, without requiring that the user dismount from the support bed and without requiring that the user interrupt an exercise/therapy workout.

13. The apparatus of claim 12, wherein said at least one control parameter is drawn from a group consisting of a measure of physical resistance associated with said workout, a parameter specifying the workout routine to be followed, total work to be performed, and number of repetitions to be performed.

14. The apparatus of claim 13, wherein said at least one parameter is drawn from the group of parameters consisting of said incline angle $\theta$, a mass m associated with said user support bed and a distance L that said user support bed moves along said inclined surface in a selected direction.

15. The apparatus of claim 12, wherein at least one of said first vertically oriented support and said second vertically oriented support comprises:

at least one vertically oriented track and at least one vertical translation wheel that is received in and rolls in at least one vertically oriented track; and an activatable motor that, when activated, causes the at least one vertical translation wheel to move vertically in a selected direction by a selected distance in the at least one vertically oriented track.

16. The apparatus of claim 12, wherein said at least one of said first vertically oriented support and said second vertically oriented support comprises:

at least one frictional block that moves up and down in at least one vertically oriented track; and an activatable motor that, when activated, causes the at least one frictional block to move vertically in a selected direction by a selected distance in the at least one vertically oriented track.

17. The apparatus of claim 12, wherein said command processor issues at least one of said electronic signals for said change in said at least one control parameter in response to at least one of (i) manual entry by said user of said command and (ii) receipt of a voice command from said user.

18. The apparatus of claim 12, wherein said command processor issues at least one of said electronic signals for said change in said at least one parameter without requiring receipt of a manual entry and without requiring receipt of a voice command from said user.

19. The apparatus of claim 12, wherein said user support bed comprises a storage region that receives and holds two or more weights.

20. The apparatus of claim 12, wherein said user support bed comprises first and second user support components, and the first user support component can be oriented relative to the second user support component at a tilt angle having at least two different tilt angle values.

21. The apparatus of claim 12, further comprising a support bed guidance mechanism that prevents said support bed from moving laterally off said inclined surface.

22. The apparatus of claim 21, wherein said support bed guidance mechanism comprises at least one of: (i) at least one rail, oriented in a selected direction along said inclined surface, which prevents said support bed from moving laterally relative to the selected direction; and (ii) first and second opposing edge regions of said inclined surface that are formed as first and second curvilinear regions that curl upward, where said support bed is received between the first and second curvilinear regions and is guided along said inclined surface in a selected direction that is substantially parallel to at least one of the first and second opposing edges.

23. Physical exercise/therapy apparatus comprising:

a bed support, comprising an inclined surface, having a bed support first end that is supported on a floor by at least one horizontal translation roller that moves along the floor and thereby allows the first end to be translated, and having a bed support second end;

a tiltable support, rotatably connected to the floor at a tilt support location, that tilts at a controllably variable tilt angle $\phi$ relative to the floor and that receives, holds and allows rotation and translation of the second support end so that the inclined surface is held at a selected incline angle $\theta$ relative to the floor;

a user support bed that supports a user and that moves along the bed support between the bed support first end and the second bed support end;

a command processor, located adjacent to or on the support bed, to receive and implement a command for a change in at least one parameter associated with an exercise/therapy workout by the user;

a vertical translation mechanism, associated with the tiltable support, that translates the bed support second end along the tiltable support by a selected amount in response to receipt of an electronic signal from the command processor, without requiring that the user dismount from the support bed and without requiring that the user interrupt an exercise/therapy workout.

24. The apparatus of claim 23, wherein said incline angle $\theta$ and said tilt angle $\phi$ are related by a relation $\tan\phi=\sin\theta/\{(L2/L1-\cos\theta\}$, where L2 is a distance along said floor from said bed support first end and to said tilt support location and L1 is a length of said bed support.

25. The apparatus of claim 23, wherein said at least one control parameter is drawn from a group consisting of a measure of physical resistance associated with said workout, a parameter specifying the workout routine to be followed, total work to be performed, and number of repetitions to be performed.

26. The apparatus of claim 25, wherein said at least one parameter is drawn from the group of parameters consisting of said incline angle $\theta$, a mass m associated with said user support bed and a distance L that said user support bed moves along said inclined surface in a selected direction.

27. The apparatus of claim 23, wherein said vertically oriented support comprises:

at least one vertically oriented track and at least one vertical translation wheel that is received in and rolls in at least one vertically oriented track; and an activatable motor that, when activated, causes the at least one vertical translation wheel to move vertically in a selected direction by a selected distance in the at least one vertically oriented track.

28. The apparatus of claim 23, wherein said vertically oriented support comprises:

at least one frictional block that moves up and down in at least one vertically oriented track; and an activatable motor that, when activated, causes the at least one frictional block to move vertically in a selected direction by a selected distance in the at least one vertically oriented track.

29. The apparatus of claim 23, wherein said command processor issues at least one of said electronic signals for said change in said at least one control parameter in response to at least one of (i) manual entry by said user of said command and (ii) receipt of a voice command from said user.

30. The apparatus of claim 23, wherein said command processor issues at least one of said electronic signals for said change in said at least one parameter without requiring receipt of a manual entry and without requiring receipt of a voice command from said user.

31. The apparatus of claim 23, wherein said user support bed comprises a storage region that receives and holds two or more weights.

32. The apparatus of claim 23, wherein said user support bed comprises first and second user support components, and the first user support component can be oriented relative to the second user support component at a tilt angle having at least two different tilt angle values.

33. The apparatus of claim 23, further comprising a support bed guidance mechanism that prevents said support bed from moving laterally off said inclined surface.

34. The apparatus of claim 33, wherein said support bed guidance mechanism comprises at least one of: (i) at least one rail, oriented in a selected direction along said inclined surface, which prevents said support bed from moving laterally relative to the selected direction; and (ii) first and second opposing edge regions of said inclined surface that are formed as first and second curvilinear regions that curl upward, where said support bed is received between the first and second curvilinear regions and is guided along said inclined surface in a selected direction that is substantially parallel to at least one of the first and second opposing edges.

35. Physical exercise/therapy apparatus comprising:

a bed support, comprising an inclined surface, having a bed support first end that is supported on a floor and allows the bed support to be rotated about the first end, and having a bed support second end;

an inclined surface support that receives, holds and allows rotation and translation of the bed support second end so that the body support is held at a selected incline angle $\theta$ relative to the floor, where the inclined surface support is curvilinear and is approximately a sector of a circle that is centered at the bed support first end;

a user support bed that supports a user and that moves along the bed support between the bed support first end and the second bed support end;

a command processor, located adjacent to or on the support bed, to receive and implement a command for a change in at least one parameter associated with an exercise/therapy workout by the user;

a curvilinear translation mechanism, associated with the bed support, that translates the bed support second end by a selected amount along a perimeter of the circle sector defined by the inclined surface support, in response to receipt of an electronic signal from the command processor, without requiring that the user dismount from the support bed and without requiring that the user interrupt an exercise/therapy workout.

36. The apparatus of claim 35, wherein said at least one control parameter is drawn from a group consisting of a measure of physical resistance associated with said workout, a parameter specifying the workout routine to be followed, total work to be performed, and number of repetitions to be performed.

37. The apparatus of claim 36, wherein said at least one parameter is drawn from the group of parameters consisting of said incline angle $\theta$, a mass m associated with said user support bed and a distance L that said user support bed moves along said inclined surface in a selected direction.

38. The apparatus of claim 35, wherein said vertically oriented support comprises:

at least one vertically oriented track and at least one vertical translation wheel that is received in and rolls in at least one vertically oriented track; and an activatable motor that, when activated, causes the at least one vertical translation wheel to move vertically in a selected direction by a selected distance in the at least one vertically oriented track.

39. The apparatus of claim 35, wherein said vertically oriented support comprises:

at least one frictional block that moves up and down in at least one vertically oriented track; and an activatable motor that, when activated, causes the at least one frictional block to move vertically in a selected direction by a selected distance in the at least one vertically oriented track.

40. The apparatus of claim 35, wherein said command processor issues at least one of said electronic signals for said change in said at least one control parameter in response to at least one of (i) manual entry by said user of said command and (ii) receipt of a voice command from said user.

41. The apparatus of claim 35, wherein said command processor issues at least one of said electronic signals for said change in said at least one parameter without requiring receipt of a manual entry and without requiring receipt of a voice command from said user.

42. The apparatus of claim 35, wherein said user support bed comprises a storage region that receives and holds two or more weights.

43. The apparatus of claim 35, wherein said user support bed comprises first and second user support components, and the first user support component can be oriented relative to the second user support component at a tilt angle having at least two different tilt angle values.

44. The apparatus of claim 35, further comprising a support bed guidance mechanism that prevents said support bed from moving laterally off said inclined surface.

45. The apparatus of claim 44, wherein said support bed guidance mechanism comprises at least one of: (i) at least one rail, oriented in a selected direction along said inclined surface, which prevents said support bed from moving laterally relative to the selected direction; and (ii) first and second opposing edge regions of said inclined surface that are formed as first and second curvilinear regions that curl upward, where said support bed is received between the first and second curvilinear regions and is guided along said inclined surface in a selected direction that is substantially parallel to at least one of the first and second opposing edges.

* * * * *